US009805677B2

(12) United States Patent
Ochiai

(10) Patent No.: US 9,805,677 B2
(45) Date of Patent: Oct. 31, 2017

(54) DISPLAY DEVICE FOR ADJUSTING CURRENT OUTPUT OF A COMMON VOLTAGE GENERATING CIRCUIT

(71) Applicant: Panasonic Liquid Crystal Display Co., Ltd., Hyogo (JP)

(72) Inventor: Katsuki Ochiai, Hyogo (JP)

(73) Assignee: PANASONIC LIQUID CRYSTAL DISPLAY CO., LTD., Hyogo (JP)

( * ) Notice: Subject to any disclaimer, the term of this patent is extended or adjusted under 35 U.S.C. 154(b) by 65 days.

(21) Appl. No.: 14/979,518

(22) Filed: Dec. 28, 2015

(65) Prior Publication Data

US 2017/0186391 A1 Jun. 29, 2017

(51) Int. Cl.
*G09G 3/36* (2006.01)

(52) U.S. Cl.
CPC ..... *G09G 3/3655* (2013.01); *G09G 3/3696* (2013.01); *G09G 2330/021* (2013.01); *G09G 2330/025* (2013.01); *G09G 2330/12* (2013.01)

(58) Field of Classification Search
CPC ..... G09G 3/3696; G09G 3/3655; G09G 2330/08; G09G 2330/10; G09G 2330/12; G09G 2330/02; G09G 2330/021; G09G 2330/025; G09G 2330/026
See application file for complete search history.

(56) References Cited

U.S. PATENT DOCUMENTS 5,828,354 A * 10/1998 Ebihara ..... G09G 3/20 345/212
7,542,021 B2 * 6/2009 Kim ..... G09G 3/3655 345/98
2002/0063703 A1 * 5/2002 Furuhashi ..... G09G 3/3655 345/212
2004/0021627 A1 * 2/2004 Maki ..... G09G 3/3648 345/89
2005/0116657 A1 * 6/2005 Park ..... G09G 3/22 315/169.3
2007/0024560 A1 * 2/2007 Kim ..... G09G 3/3614 345/94
2008/0198125 A1 * 8/2008 Park ..... G09G 3/3696 345/98

(Continued)

FOREIGN PATENT DOCUMENTS

JP 2013-238846 A 11/2013

*Primary Examiner* — Darlene M Ritchie
(74) *Attorney, Agent, or Firm* — Hubbs, Enatsky & Inoue PLLC

(57) ABSTRACT

Provided is a display device, including: a display panel including a pixel electrode and a common electrode; a common voltage generating circuit configured to generate a common voltage to be supplied to the common electrode; a plurality of common transmission lines configured to transmit, to the common electrode, the common voltage generated by the common voltage generating circuit; a plurality of detection units, which are connected to the plurality of common transmission lines, respectively, and are configured to detect a transmission error of the common voltage in the plurality of common transmission lines, respectively; and a current adjusting unit configured to adjust a current amount of an output current of the common voltage generating circuit based on detection results of the plurality of detection units.

9 Claims, 4 Drawing Sheets

(56) References Cited

U.S. PATENT DOCUMENTS

| | | | | |
|---|---|---|---|---|
| 2009/0167659 | A1* | 7/2009 | Kim | G09G 3/3655 345/89 |
| 2009/0219307 | A1* | 9/2009 | Yaguma | G09G 3/3655 345/690 |
| 2009/0267886 | A1* | 10/2009 | Ishiguchi | G09G 3/3655 345/98 |
| 2010/0245326 | A1* | 9/2010 | Xiao | G09G 3/3655 345/211 |
| 2013/0307761 | A1* | 11/2013 | Kwak | G09G 3/3696 345/87 |
| 2014/0354618 | A1* | 12/2014 | Shin | G09G 3/3225 345/212 |
| 2015/0371601 | A1* | 12/2015 | Kim | G06F 1/28 345/212 |
| 2016/0293116 | A1* | 10/2016 | Wang | G09G 3/3655 |

* cited by examiner

DISPLAY DEVICE FOR ADJUSTING CURRENT OUTPUT OF A COMMON VOLTAGE GENERATING CIRCUIT

BACKGROUND OF THE INVENTION

1. Field of the Invention

The present application relates to a display device.

2. Description of the Related Art

Among various types of display devices, a liquid crystal display device, for example, is configured to display an image by applying, to liquid crystal, an electric field generated between a pixel electrode formed in each pixel region and a common electrode to drive the liquid crystal, thereby adjusting an amount of light passing through a region between the pixel electrode and the common electrode. The common electrode is supplied with a common voltage output from an external circuit via a common transmission line.

Hitherto, in order to respond to increases in definition and size of a display panel, there has been proposed a technology of supplying a common voltage to the common electrode from both sides of the display panel. Further, in the above-mentioned display panel, there has been proposed a technology of suppressing fluctuations in common voltage to be supplied to the common electrode. For example, in Japanese Patent Application Laid-open No. 2013-238846, there is disclosed a technology of feedback controlling a common voltage of a particular region in the common electrode to supply the common voltage to the common electrode.

SUMMARY OF THE INVENTION

However, in the related art, for example, the common transmission lines configured to transmit the common voltage are arranged on both sides of the display panel. When an abnormality occurs at a connection portion (power feeding portion) between one common transmission line and the display panel, and thus a transmission error of the common voltage occurs to lower the current supply performance of the transmission line, the current amount in another common transmission line is increased. Then, when the current amount of the above-mentioned another common transmission line exceeds an allowable current amount of the above-mentioned connection portion, there arise problems in that an abnormality occurs in the display panel, and the reliability of the display panel is lowered.

The present application has been made in view of the above-mentioned problems, and has an object to provide a display device including a plurality of common transmission lines configured to transmit a common voltage to a common electrode, which is capable of, when a transmission error of the common voltage has occurred in any of the common transmission lines, preventing the current amount of another common transmission line from increasing to be equal to or larger than an allowable current amount.

In order to solve the above-mentioned problems, according to one embodiment of the present application, there is provided a display device, including: a display panel including a pixel electrode and a common electrode; a common voltage generating circuit configured to generate a common voltage to be supplied to the common electrode; a plurality of common transmission lines configured to transmit, to the common electrode, the common voltage generated by the common voltage generating circuit; a plurality of detection units, which are connected to the plurality of common transmission lines, respectively, and are configured to detect a transmission error of the common voltage in the plurality of common transmission lines, respectively; and a current adjusting unit configured to adjust a current amount of an output current of the common voltage generating circuit based on detection results of the plurality of detection units.

In the display device according to one embodiment of the present application, when the transmission error has occurred in any one of the plurality of common transmission lines, the current adjusting unit may adjust the output current of the common voltage generating circuit so that a current amount of the output current is reduced.

In the display device according to one embodiment of the present application, the common voltage generating circuit may include an operational amplifier, the operational amplifier may have a first input terminal configured to input a reference voltage, the operational amplifier may have a second input terminal configured to input a feedback voltage from the common electrode, the operational amplifier may have an output terminal connected to an input terminal of the current adjusting unit, and the current adjusting unit may have an output terminal connected to the plurality of common transmission lines.

The display device according to one embodiment of the present application may further include n common transmission lines. In the display device, when no transmission error occurs, the current adjusting unit may output the output current in an current amount I, and when the transmission error has occurred in m common transmission lines among the plurality of common transmission lines, the current adjusting unit may output the output current in a current amount of $I\times(n-m)/n$.

In the display device according to one embodiment of the present application, the current adjusting unit may include: a push-pull circuit including two transistors; and a switch configured to short-circuit an input terminal and an output terminal of the push-pull circuit. In the display device, when the transmission error has occurred in any one of the plurality of common transmission lines, the current adjusting unit may short-circuit the input terminal and the output terminal of the push-pull circuit so that the output current of the operational amplifier is output to, among the plurality of common transmission lines, the common transmission line without the transmission error, and when no transmission error occurs in the plurality of common transmission lines, the current adjusting unit may output the output current of the operational amplifier to the plurality of common transmission lines while amplifying the output current by the push-pull circuit.

In the display device according to one embodiment of the present application, the current adjusting unit may include a plurality of resistors having different resistance values from each other, the current adjusting unit may be configured to select one of the plurality of resistors based on a number of the common transmission lines in which the transmission error has occurred among the plurality of common transmission lines, and the output terminal of the operational amplifier and the one of the plurality of resistors selected by the current adjusting unit may be electrically connected to each other.

In the display device according to one embodiment of the present application, the common voltage generating circuit may include an operational amplifier, the operational amplifier may have a first input terminal configured to input a reference voltage, the operational amplifier may have a second input terminal connected to an output terminal of the current adjusting unit, and the current adjusting unit may have an input terminal configured to input a feedback voltage from the common electrode.

In the display device according to one embodiment of the present application, the current adjusting unit may include a plurality of resistors having different resistance values from each other, the current adjusting unit may be configured to select one of the plurality of resistors based on a number of the common transmission lines in which the transmission error has occurred among the plurality of common transmission lines, and the second input terminal of the operational amplifier and the one of the plurality of resistors selected by the current adjusting unit may be electrically connected to each other.

DETAILED DESCRIPTION OF THE INVENTION

An embodiment of the present application is described below with reference to the accompanying drawings. In the following, a liquid crystal display device is taken as an example, but a display device according to the present application is not limited to the liquid crystal display device, and may be, for example, an organic EL display device.

Figure 1:
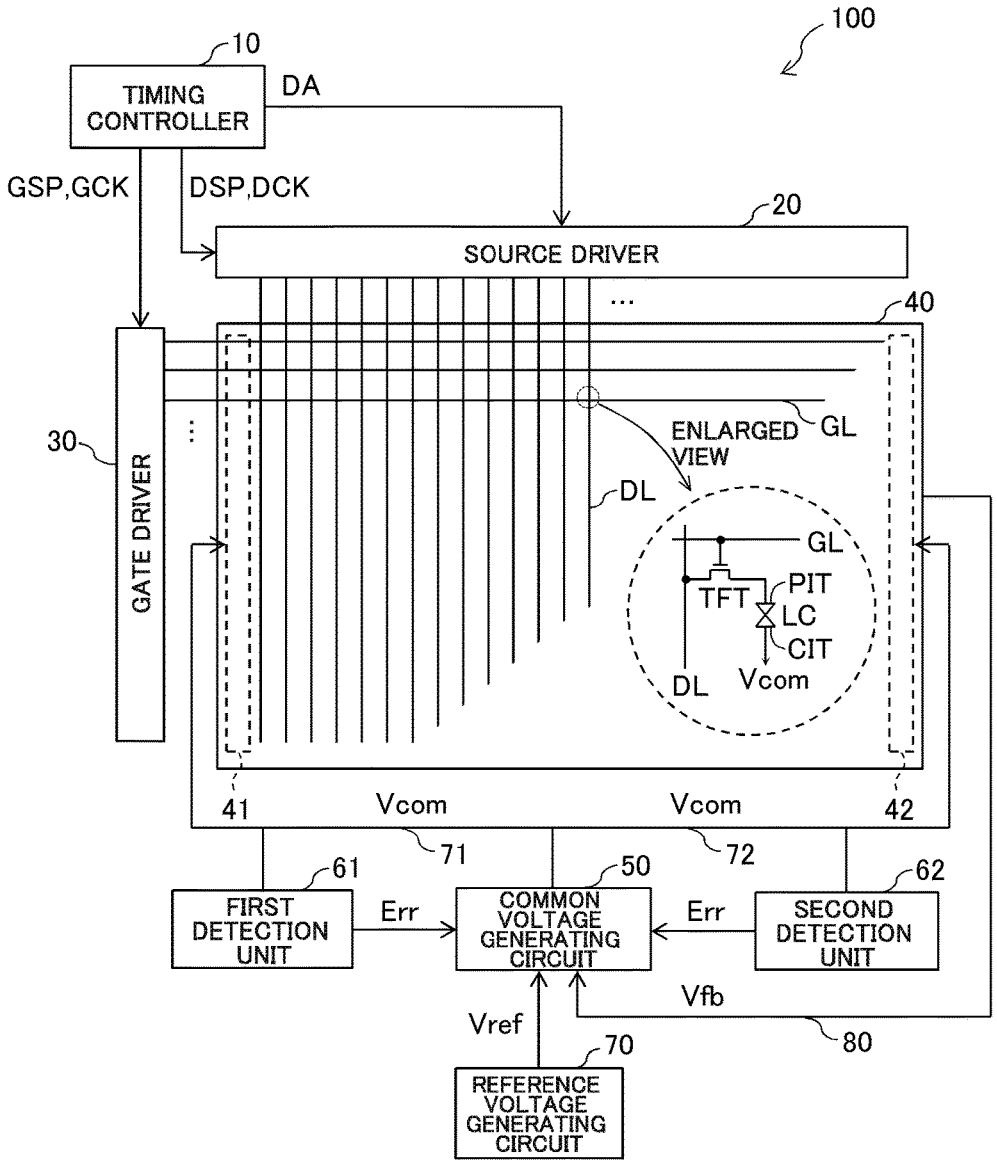
FIG. 1 is a diagram for illustrating a schematic configuration of a liquid crystal display device according to an embodiment of the present application.

FIG. 1 is a diagram for illustrating a schematic configuration of a liquid crystal display device according to the embodiment of the present application. A liquid crystal display device 100 according to this embodiment is configured to transmit data by a serial transmission system. The liquid crystal display device 100 includes a timing controller 10, a source driver 20, a gate driver 30, a display panel 40, a common voltage generating circuit 50, a first detection unit 61, a second detection unit 62, and a reference voltage generating circuit 70.

The timing controller 10 is configured to generate display data DA for image display and a plurality of timing signals for defining the operation timing of the source driver 20 and the gate driver 30. Specifically, the timing controller 10 is configured to generate, based on control signals (clock signal, vertical synchronizing signal, and horizontal synchronizing signal) to be supplied from an external system (not shown), a plurality of timing signals including a data start pulse DSP, a data clock DCK, a gate start pulse GSP, and a gate clock GCK. The timing controller 10 is configured to supply the plurality of generated timing signals to the source driver 20 and the gate driver 30 to control the drive of the source driver 20 and the gate driver 30. For example, the timing controller 10 is configured to supply the data start pulse DSP, the data clock DCK, and the display data DA to the source driver 20. Further, the timing controller 10 is configured to supply the gate start pulse GSP and the gate clock GCK to the gate driver 30. A known configuration can be applied to the timing controller 10.

The source driver 20 is configured to output a grayscale voltage to a plurality of data lines DL based on the data start pulse DSP, the data clock DCK, the display data DA, and other signals, which are input from the timing controller 10.

The gate driver 30 is configured to sequentially output a gate signal (scanning signal) to a plurality of gate lines GL based on the gate start pulse GSP, the gate clock GCK, and other signals, which are output from the timing controller 10.

The display panel 40 includes a thin film transistor substrate (TFT substrate) (not shown), a color filter substrate (CF substrate) (not shown), and a liquid crystal layer LC sandwiched between both of the substrates. The TFT substrate includes the plurality of data lines DL connected to the source driver 20, and the plurality of gate lines GL connected to the gate driver 30. A thin film transistor TFT is formed at each intersecting portion between each data line DL and each gate line GL. Further, in the display panel 40, a plurality of pixels are arranged in matrix (in a row direction and a column direction) so as to correspond to the respective intersecting portions. Further, the display panel 40 includes a pixel electrode PIT and a common electrode CIT so as to correspond to each pixel. The display panel 40 is configured to turn on the thin film transistor TFT by the gate signal supplied to the gate line GL, and supply the grayscale voltage to the pixel electrode PIT via the data line DL. Note that, the source driver 20 and the gate driver 30 may be formed on the TFT substrate. The display panel 40 is not limited to the above-mentioned configuration, and a known configuration can be applied thereto.

The liquid crystal display device 100 further includes a first common transmission line 71, a second common transmission line 72, and a feedback line 80. The first common transmission line 71, the second common transmission line 72, and the feedback line 80 may be arranged in the display panel 40. Further, the display panel 40 further includes a first power feeding portion 41 and a second power feeding portion 42. The first power feeding portion 41 is arranged at one end portion of the display panel 40, and the second power feeding portion 42 is arranged at another end portion of the display panel 40.

The common voltage generating circuit 50 is configured to generate a common voltage Vcom based on a reference voltage Vref output from the reference voltage generating circuit 70, to thereby output the generated common voltage Vcom to the display panel 40. The common voltage Vcom generated by the common voltage generating circuit 50 is transmitted to the first power feeding portion 41 via the first common transmission line 71, and is also transmitted to the second power feeding portion 42 via the second common transmission line 72. Each of the first power feeding portion 41 and the second power feeding portion 42 is electrically connected to the common electrode CIT. With this, the common voltage Vcom is supplied to the common electrode CIT via the first power feeding portion 41 and the second power feeding portion 42. The first power feeding portion 41 and the second power feeding portion 42 may be arranged at right and left end portions of the display panel 40, or may be arranged at upper and lower end portions thereof. Further, the number of the common transmission lines and the number of the power feeding portions are not limited as long as the numbers are two or more.

One end of the feedback line 80 is electrically connected to the common electrode CIT, and the other end of the feedback line 80 is electrically connected to the common voltage generating circuit 50. With this, a feedback voltage Vfb is input to the common voltage generating circuit 50 via the feedback line 80.

The first detection unit 61 is electrically connected to the first common transmission line 71, and is configured to monitor the transmission state of the common voltage Vcom between the common voltage generating circuit 50 and the first power feeding portion 41, to thereby detect a transmission error. The second detection unit 62 is electrically connected to the second common transmission line 72, and is configured to monitor the transmission state of the common voltage Vcom between the common voltage generating circuit 50 and the second power feeding portion 42, to thereby detect a transmission error. Examples of the transmission error include connection failure between the common transmission line and the power feeding portion, disconnection of the common transmission line, and damage of the power feeding portion. When each of the first detection unit 61 and the second detection unit 62 detects a transmission error, each of the first detection unit 61 and the second detection unit 62 transmits an error signal Err to the common voltage generating circuit 50.

The common voltage generating circuit 50 is configured to adjust a current amount of an output current of the common voltage generating circuit 50 in response to reception of the error signal Err from each of the first detection unit 61 and the second detection unit 62. In the following, the specific configuration of the common voltage generating circuit 50 is described.

Figure 2:
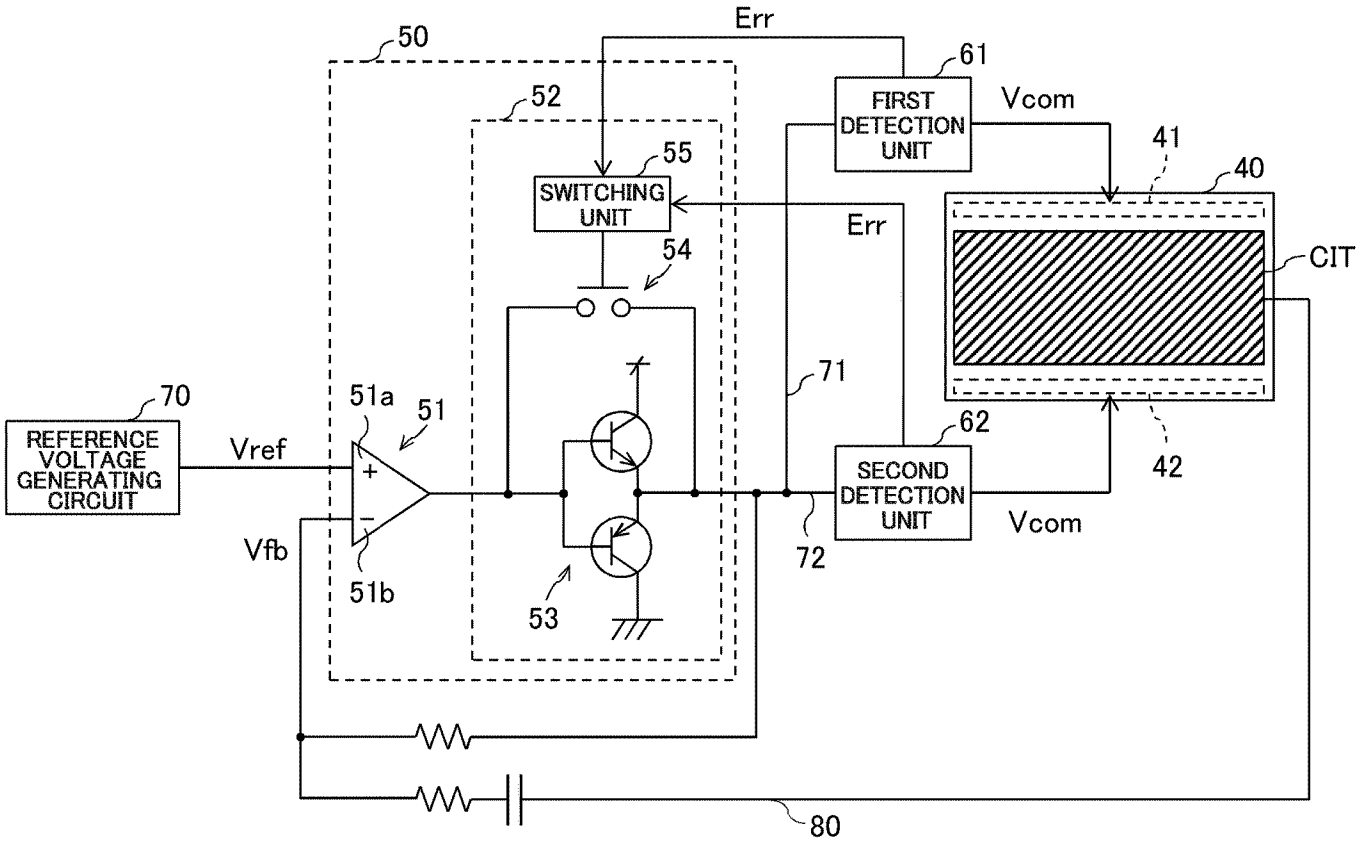
FIG. 2 is a diagram for illustrating a specific circuit configuration of a common voltage generating circuit according to the embodiment of the present application.

FIG. 2 is a diagram for illustrating the specific circuit configuration of the common voltage generating circuit 50. The common voltage generating circuit 50 includes an operational amplifier 51 and a current adjusting unit 52. The current adjusting unit 52 includes a push-pull circuit 53, a change-over switch 54, and a switching unit 55.

The operational amplifier 51 has a first input terminal 51*a* connected to the reference voltage generating circuit 70, and a second input terminal 51*b* connected to the feedback line 80 via a resistor and a capacitor. With this, the reference voltage Vref is input to the first input terminal 51*a*, and the feedback voltage Vfb is input to the second input terminal 51*b*. Further, the second input terminal 51*b* of the operational amplifier 51 is connected to an output terminal of the common voltage generating circuit 50 via a resistor. The operational amplifier 51 is configured to output the common voltage Vcom based on the reference voltage Vref and the feedback voltage Vfb. Note that, as the operational amplifier 51 in the configuration of FIG. 2, for example, an operational amplifier having a small output current and low drive performance is used.

The operational amplifier 51 has an output terminal connected to an input terminal of the push-pull circuit 53. The push-pull circuit 53 includes two transistors. With this, the output current of the operational amplifier 51 is amplified by the push-pull circuit 53, and the amplified current is output from the common voltage generating circuit 50. A known configuration can be applied to the push-pull circuit 53.

An input terminal of the change-over switch 54 is connected to the input terminal of the push-pull circuit 53, and an output terminal of the change-over switch 54 is connected to an output terminal of the push-pull circuit 53. Further, a control terminal of the change-over switch 54 is connected to the switching unit 55. The switching unit 55 is connected to the first detection unit 61 and the second detection unit 62, and is configured to receive the error signal Err from the detection unit that has detected a transmission error. The switching unit 55 is configured to output, to the change-over switch 54, a switching signal for switching the switch in response to reception of the error signal Err. When the change-over switch 54 is turned on, the input terminal and the output terminal of the push-pull circuit 53 are short-circuited. With this, the output current of the operational amplifier 51 is output from the common voltage generating circuit 50 via the change-over switch 54.

The common voltage Vcom generated by the common voltage generating circuit 50 is transmitted to the first power feeding portion 41 of the display panel 40 via the first common transmission line 71, and is transmitted to the second power feeding portion 42 of the display panel 40 via the second common transmission line 72. The common voltage Vcom is supplied to the common electrode CIT via the first power feeding portion 41 and the second power feeding portion 42.

Description is given of the operation of the common voltage generating circuit 50 when a transmission error of the common voltage Vcom has occurred in the configuration illustrated in FIG. 2. For example, when connection failure has occurred between the first common transmission line 71 and the first power feeding portion 41, the first detection unit 61 detects the transmission error of the common voltage Vcom in the first common transmission line 71. When the first detection unit 61 detects the transmission error, the first detection unit 61 outputs the error signal Err to the switching unit 55. When the switching unit 55 receives the error signal Err, the switching unit 55 outputs the switching signal to the change-over switch 54. When the change-over switch 54 receives the switching signal, the change-over switch 54 is turned on, and the input terminal and the output terminal of the push-pull circuit 53 are short-circuited. With this, an output current in a small current amount is output from the operational amplifier 51, to thereby be fed to the second power feeding portion 42 via the normal second common transmission line 72.

As described above, the common voltage generating circuit 50 illustrated in FIG. 2 is configured to adjust the current amount of the output current of the common voltage generating circuit 50 based on the detection results of the plurality of detection units. That is, when a transmission error of the common voltage Vcom has occurred in any of the common transmission lines, the common voltage generating circuit 50 outputs the output current of the operational amplifier 51 in a small current amount to the normal common transmission line while bypassing the push-pull circuit 53. With this, concentration of a current exceeding an allowable current amount on the normal common transmission line can be prevented. Further, even when the above-mentioned transmission error has occurred, the common voltage Vcom is supplied to the common electrode CIT via the normal common transmission line, and hence the image display can be maintained. In FIG. 2, an example of two common transmission lines is given, but the number of the common transmission lines may be three or more. For example, when the number of the common transmission lines is three and the transmission error of the common voltage Vcom has occurred in any one of the common transmission lines, the output current of the operational amplifier 51 is distributed to the remaining two normal common transmission lines.

Figure 3:
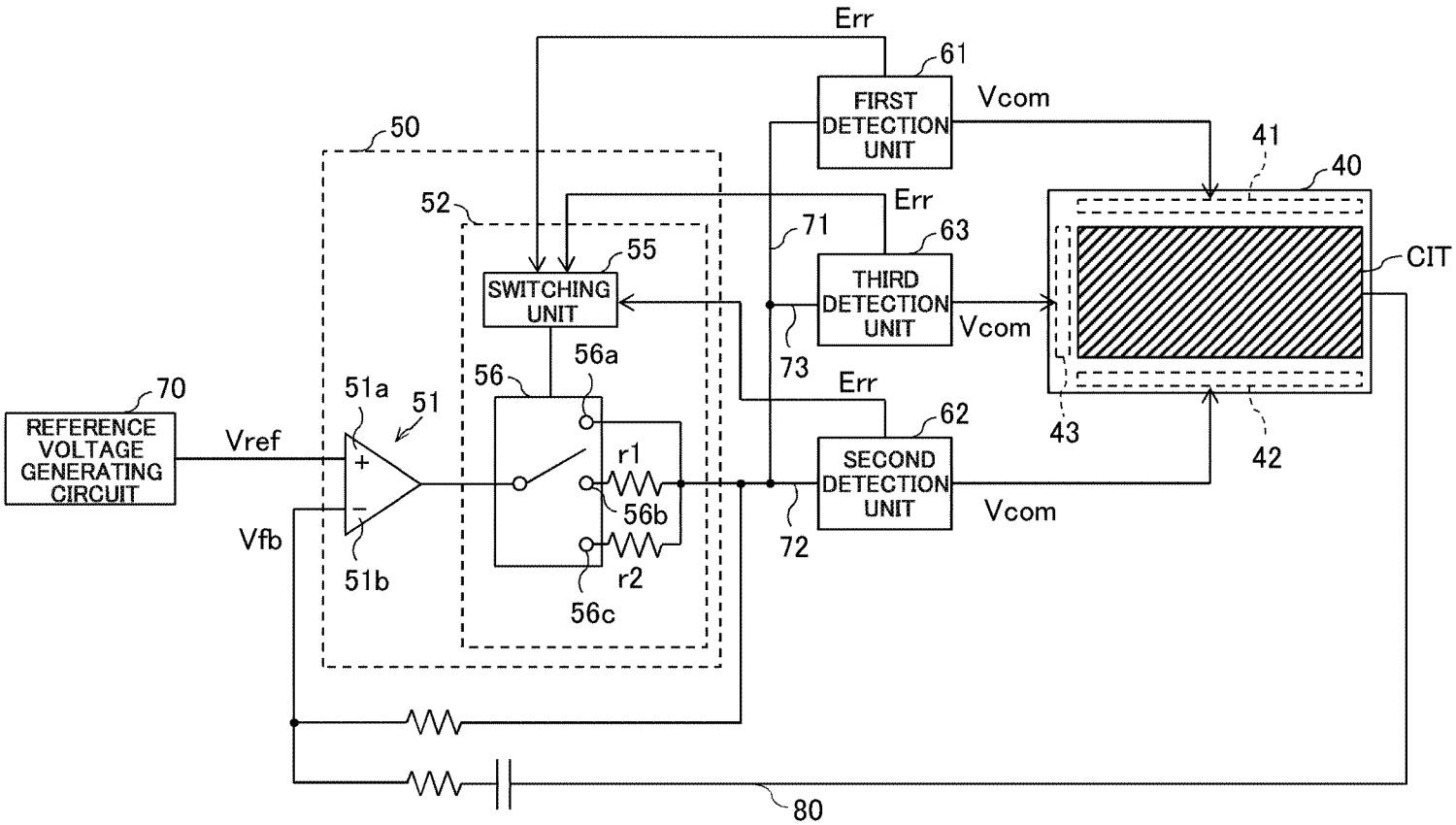
FIG. 3 is a diagram for illustrating another circuit configuration of the common voltage generating circuit according to the embodiment of the present application.

The common voltage generating circuit 50 is not limited to the configuration of FIG. 2. FIG. 3 is a diagram for illustrating another circuit configuration of the common voltage generating circuit 50. In the common voltage generating circuit 50 illustrated in FIG. 3, the same components as those in the common voltage generating circuit 50 illustrated in FIG. 2 are denoted by the same reference symbols, and description thereof is omitted herein. The common voltage generating circuit 50 illustrated in FIG. 3 includes three common transmission lines (first common transmission line 71, second common transmission line 72, and third common transmission line 73) and three detection units (first detection unit 61, second detection unit 62, and third detection unit 63). Further, in the common voltage generating circuit 50 illustrated in FIG. 3, the current adjusting unit 52 includes the switching unit 55, a change-over switch 56, and resistors r1 and r2. A resistance value R2 of the resistor r2 is set to be larger than a resistance value R1 of the resistor r1 (R1<R2).

An input terminal of the change-over switch 56 is connected to the output terminal of the operational amplifier 51. A first output terminal 56*a* of the change-over switch 56 is connected to the output terminal of the common voltage generating circuit 50. A second output terminal 56*b* of the change-over switch 56 is connected to an input terminal of the resistor r1, and an output terminal of the resistor r1 is connected to the output terminal of the common voltage generating circuit 50. A third output terminal 56*c* of the change-over switch 56 is connected to an input terminal of the resistor r2, and an output terminal of the resistor r2 is connected to the output terminal of the common voltage generating circuit 50.

The switching unit 55 is connected to the first detection unit 61, the second detection unit 62, and the third detection unit 63, and is configured to receive the error signal Err from the detection unit that has detected a transmission error. The switching unit 55 is configured to output, to the change-over switch 56, a switching signal for switching the switch based on whether or not the error signal Err is detected. For example, the switching unit 55 is configured to output a first switching signal when no error signal Err is received from the above-mentioned three detection units, output a second switching signal when the error signal Err is received from one of the above-mentioned three detection units, and output a third switching signal when the error signal Err is received from two of the above-mentioned three detection units.

When the change-over switch 56 receives the first switching signal from the switching unit 55, the change-over switch 56 selects the first output terminal 56*a* to directly connect the output terminal of the operational amplifier 51 and the output terminal of the common voltage generating circuit 50 to each other. Further, when the change-over switch 56 receives the second switching signal from the switching unit 55, the change-over switch 56 selects the second output terminal 56*b* to connect the output terminal of the operational amplifier 51 and the resistor r1 to each other. Further, when the change-over switch 56 receives the third switching signal from the switching unit 55, the change-over switch 56 selects the third output terminal 56*c* to connect the output terminal of the operational amplifier 51 and the resistor r2 to each other.

The common voltage Vcom generated by the common voltage generating circuit 50 is transmitted to the first power feeding portion 41 of the display panel 40 via the first common transmission line 71, is transmitted to the second power feeding portion 42 of the display panel 40 via the second common transmission line 72, and is transmitted to a third power feeding portion 43 of the display panel 40 via the third common transmission line 73. The common voltage Vcom is supplied to the common electrode CIT via the first power feeding portion 41, the second power feeding portion 42, and the third power feeding portion 43.

Description is given of the operation of the common voltage generating circuit 50 when the transmission error of the common voltage Vcom has occurred in the configuration illustrated in FIG. 3. For example, when connection failure has occurred between the first common transmission line 71 and the first power feeding portion 41, the first detection unit 61 detects the transmission error of the common voltage Vcom in the first common transmission line 71. When the first detection unit 61 detects the transmission error, the first detection unit 61 outputs the error signal Err to the switching unit 55. When the switching unit 55 receives the error signal Err from the first detection unit 61, the switching unit 55 outputs the second switching signal to the change-over switch 56. When the change-over switch 56 receives the second switching signal, the change-over switch 56 selects the second output terminal 56*b* to connect the output terminal of the operational amplifier 51 and the resistor r1 to each other. With this, an output current I of the operational amplifier 51 is reduced in current amount by the resistor r1, and the common voltage generating circuit 50 outputs an output current I1 (I1<I). The output current I1 is distributed to the normal second common transmission line 72 and the normal third common transmission line 73, to thereby be fed to the second power feeding portion 42 and the third power feeding portion 43.

Further, for example, when connection failure has occurred also between the second common transmission line 72 and the second power feeding portion 42 in addition to the connection failure between the first common transmission line 71 and the first power feeding portion 41, each of the first detection unit 61 and the second detection unit 62 detects the transmission error. When each of the first detection unit 61 and the second detection unit 62 detects the transmission error, each of the first detection unit 61 and the second detection unit 62 outputs the error signal Err to the switching unit 55. When the switching unit 55 receives the error signal Err from each of the first detection unit 61 and the second detection unit 62, the switching unit 55 outputs the third switching signal to the change-over switch 56. When the change-over switch 56 receives the third switching signal, the change-over switch 56 selects the third output terminal 56*c* to connect the output terminal of the operational amplifier 51 and the resistor r2 to each other. With this, the output current I of the operational amplifier 51 is reduced in current amount by the resistor r2, and the common voltage generating circuit 50 outputs an output current I2 (I2<I1<I). The output current I2 is fed to the third power feeding portion 43 via the normal third common transmission line 73.

As described above, the common voltage generating circuit 50 illustrated in FIG. 3 is configured to, when the transmission error of the common voltage Vcom has occurred in any of the common transmission lines, output the output current of the operational amplifier 51 to the normal common transmission line while reducing its current amount by the resistor. Further, the common voltage generating circuit 50 illustrated in FIG. 3 is configured to adjust the current amount of the output current based on the number of abnormal common transmission lines. In other words, the common voltage generating circuit 50 illustrated in FIG. 3 is configured to adjust the current amount of the output current based on the number of the normal common transmission lines. With this, concentration of a current exceeding an allowable current amount on the normal common transmission line can be prevented. Further, even when the above-mentioned transmission error has occurred, the common voltage Vcom is supplied to the common electrode CIT via the normal common transmission line, and hence the image display can be maintained.

When the liquid crystal display device 100 includes n common transmission lines having equivalent allowable current amounts, the liquid crystal display device 100 may have the following configuration. When the current amount of the output current of the current adjusting unit 52 in a case of non-occurrence of the transmission error is represented by I, and when the transmission error has occurred in m common transmission lines among the n common transmission lines, the current adjusting unit 52 may output an output current in a current amount of $I\times(n-m)/n$.

Note that, when no transmission error of the common voltage Vcom occurs, the switching unit 55 outputs the first switching signal to the change-over switch 56. When the change-over switch 56 receives the first switching signal, the change-over switch 56 selects the first output terminal 56*a* to directly connect the output terminal of the operational amplifier 51 and the output terminal of the common voltage generating circuit 50 to each other. With this, the output current I of the operational amplifier 51 in a large current amount is output. The output current I is distributed to the first common transmission line 71, the second common transmission line 72, and the third common transmission line 73, to thereby be fed to the first power feeding portion 41, the second power feeding portion 42, and the third power feeding portion 43.

Figure 4:
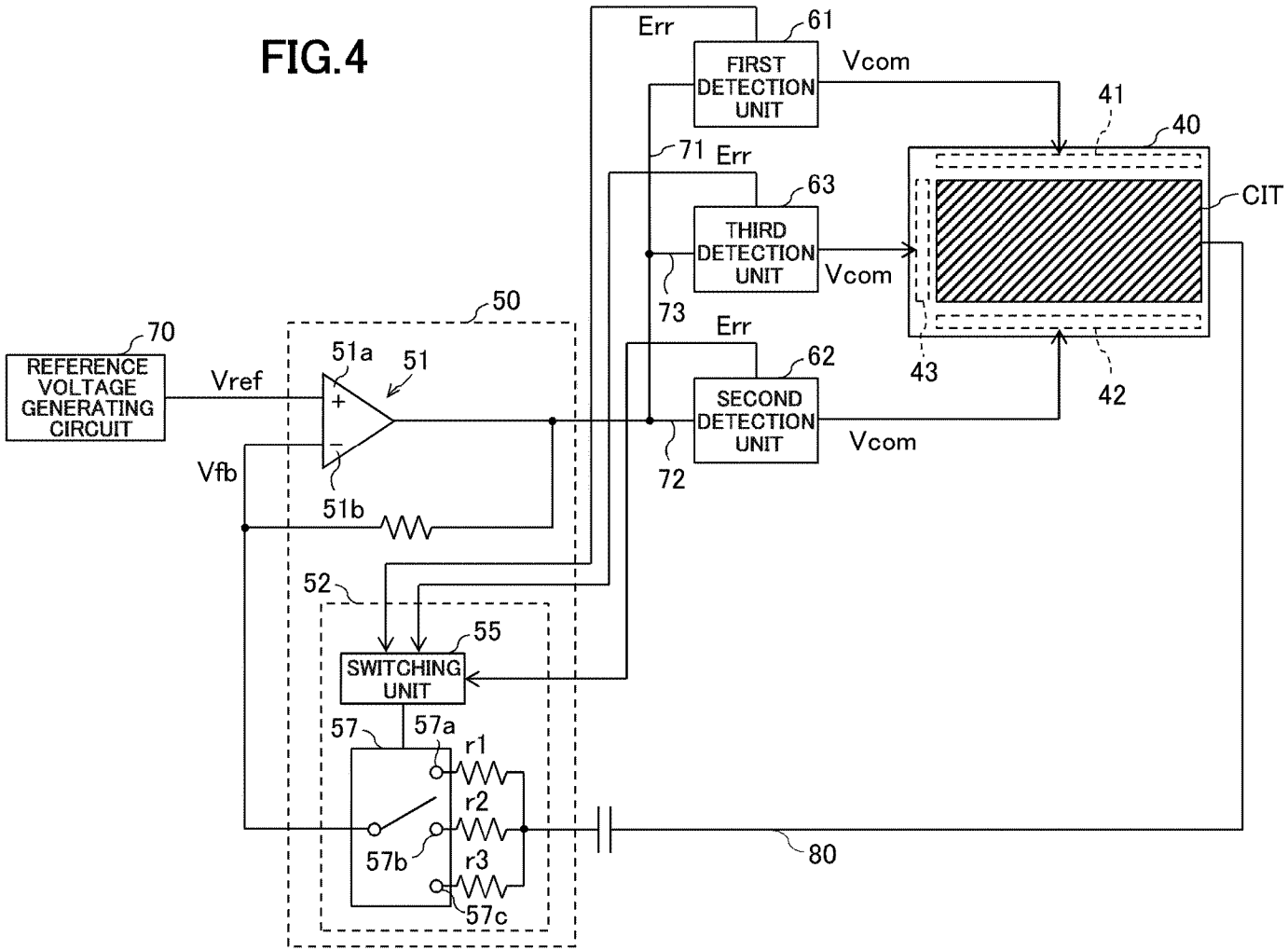
FIG. 4 is a diagram for illustrating another circuit configuration of the common voltage generating circuit according to the embodiment of the present application.

FIG. 4 is a diagram for illustrating another circuit configuration of the common voltage generating circuit 50. In the common voltage generating circuit 50 illustrated in FIG. 4, the same components as those in the common voltage generating circuit 50 illustrated in FIG. 3 are denoted by the same reference symbols, and description thereof is omitted herein. In the common voltage generating circuit 50 illustrated in FIG. 4, the input terminal of the current adjusting unit 52 is connected to the feedback line 80 via a capacitor, and the output terminal of the current adjusting unit 52 is connected to the second input terminal 51*b* of the operational amplifier 51.

The current adjusting unit 52 includes the switching unit 55, a change-over switch 57, and resistors r1, r2, and r3. The resistance value R2 of the resistor r2 is set larger than the resistance value R1 of the resistor r1, and a resistance value R3 of the resistor r3 is set larger than the resistance value R2 of the resistor r2 ($R1<R2<R3$).

The input terminal of each of the resistors r1, r2, and r3 is connected to the feedback line 80 via the capacitor. The output terminal of the resistor r1 is connected to a first input terminal 57*a* of the change-over switch 57. The output terminal of the resistor r2 is connected to a second input terminal 57*b* of the change-over switch 57. An output terminal of the resistor r3 is connected to a third input terminal 57*c* of the change-over switch 57. An output terminal of the change-over switch 57 is connected to the second input terminal 51*b* of the operational amplifier 51.

The switching unit 55 is connected to the first detection unit 61, the second detection unit 62, and the third detection unit 63, and is configured to receive the error signal Err from the detection unit that has detected a transmission error. The switching unit 55 is configured to output, to the change-over switch 56, a switching signal for switching the switch based on whether or not the error signal Err is detected. For example, the switching unit 55 is configured to output a first switching signal when no error signal Err is received from the above-mentioned three detection units, output a second switching signal when the error signal Err is received from one of the above-mentioned three detection units, and output a third switching signal when the error signal Err is received from two of the above-mentioned three detection units.

When the change-over switch 57 receives the first switching signal from the switching unit 55, the change-over switch 57 selects the first input terminal 57*a* to connect the second input terminal 51*b* of the operational amplifier 51 and the resistor r1 to each other. Further, when the change-over switch 57 receives the second switching signal from the switching unit 55, the change-over switch 57 selects the second input terminal 57*b* to connect the second input terminal 51*b* of the operational amplifier 51 and the resistor r2 to each other. Further, when the change-over switch 57 receives the third switching signal from the switching unit 55, the change-over switch 57 selects the third input terminal 57*c* to connect the second input terminal 51*b* of the operational amplifier 51 and the resistor r3 to each other.

The operational amplifier 51 is configured to output the common voltage Vcom based on the reference voltage Vref and the feedback voltage Vfb input via the current adjusting unit 52. That is, the current adjusting unit 52 functions as a gain adjusting unit for the operational amplifier 51.

In the configuration illustrated in FIG. 4, when no transmission error of the common voltage Vcom occurs, the switching unit 55 outputs the first switching signal to the change-over switch 57. When the change-over switch 57 receives the first switching signal, the change-over switch 57 selects the first input terminal 57*a* to connect the second input terminal 51*b* of the operational amplifier 51 and the resistor r1 to each other. With this, the operational amplifier 51 outputs an output voltage based on the resistor r1 as the common voltage Vcom. Further, the operational amplifier 51 outputs the output current I1 in a current amount based on the resistor r1. The output current I1 is distributed to the first common transmission line 71, the second common transmission line 72, and the third common transmission line 73, to thereby be fed to the first power feeding portion 41, the second power feeding portion 42, and the third power feeding portion 43.

The common voltage generating circuit 50 operates as follows when the transmission error of the common voltage Vcom has occurred in the configuration illustrated in FIG. 4. For example, when connection failure has occurred between the first common transmission line 71 and the first power feeding portion 41, the first detection unit 61 detects the transmission error of the common voltage Vcom in the first common transmission line 71. When the first detection unit 61 detects the transmission error, the first detection unit 61 outputs the error signal Err to the switching unit 55. When the switching unit 55 receives the error signal Err from the first detection unit 61, the switching unit 55 outputs the second switching signal to the change-over switch 57. When the change-over switch 57 receives the second switching signal, the change-over switch 57 selects the second input terminal 57*b* to connect the second input terminal 51*b* of the operational amplifier 51 and the resistor r2 to each other. With this, the operational amplifier 51 outputs an output voltage based on the resistor r2 as the common voltage Vcom. Further, the operational amplifier 51 outputs the output current I2 ($I2<I1$) in a current amount based on the resistor r2. The output current I2 is distributed to the normal second common transmission line 72 and the normal third common transmission line 73, to thereby be fed to the second power feeding portion 42 and the third power feeding portion 43.

Further, for example, when connection failure has occurred also between the second common transmission line 72 and the second power feeding portion 42 in addition to the connection failure between the first common transmission line 71 and the first power feeding portion 41, each of the first detection unit 61 and the second detection unit 62 detects the transmission error. When each of the first detection unit 61 and the second detection unit 62 detects the transmission error, each of the first detection unit 61 and the second detection unit 62 outputs the error signal Err to the switching unit 55. When the switching unit 55 receives the error signal Err from each of the first detection unit 61 and the second detection unit 62, the switching unit 55 outputs the third switching signal to the change-over switch 57. When the change-over switch 57 receives the third switching signal, the change-over switch 57 selects the third input terminal 57*c* to connect the second input terminal 51*b* of the operational amplifier 51 and the resistor r3 to each other. With this, the operational amplifier 51 outputs an output voltage based on the resistor r3 as the common voltage Vcom. Further, the operational amplifier 51 outputs the output current I3 (I3<I2<I1) in a current amount based on the resistor r3. The output current I3 is fed to the third power feeding portion 43 via the normal third common transmission line 73.

As described above, similarly to the common voltage generating circuit 50 illustrated in FIG. 3, in the common voltage generating circuit 50 illustrated in FIG. 4, when the transmission error of the common voltage Vcom has occurred in any of the common transmission lines, the output current of the operational amplifier 51 is output to the normal common transmission line while reducing its current amount by the resistor. With this, concentration of a current exceeding an allowable current amount on the normal common transmission line can be prevented. Further, even when the above-mentioned transmission error has occurred, the common voltage Vcom is supplied to the common electrode CIT via the normal common transmission line, and hence the image display can be maintained.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A display device, comprising:

a display panel comprising a pixel electrode and a common electrode;

a common voltage generating circuit configured to generate a common voltage to be supplied to the common electrode;

a plurality of common transmission lines configured to transmit, to the common electrode, the common voltage generated by the common voltage generating circuit;

a plurality of detectors, which are connected to the plurality of common transmission lines, respectively, and are configured to detect a transmission error of the common voltage in the plurality of common transmission lines, respectively;

a current adjusting unit configured to adjust a current amount of an output current of the common voltage generating circuit based on detection results of the plurality of detectors; and n common transmission lines, wherein, when no transmission error occurs, the current adjusting unit outputs the output current in a current amount I, and wherein, when the transmission error has occurred in m common transmission lines among the plurality of common transmission lines, the current adjusting unit outputs the output current in a current amount of I×(n−m)/n.

2. The display device according to claim 1, wherein, when the transmission error has occurred in any one of the plurality of common transmission lines, the current adjusting unit adjusts the output current of the common voltage generating circuit so that a current amount of the output current is reduced.

3. The display device according to claim 1, wherein the common voltage generating circuit comprises an operational amplifier, wherein the operational amplifier has a first input terminal configured to input a reference voltage, wherein the operational amplifier has a second input terminal configured to input a feedback voltage from the common electrode, wherein the operational amplifier has an output terminal connected to an input terminal of the current adjusting unit, and wherein the current adjusting unit has an output terminal connected to the plurality of common transmission lines.

4. A display device, comprising:

a display panel comprising a pixel electrode and a common electrode;

a common voltage generating circuit configured to generate a common voltage to be supplied to the common electrode;

a plurality of common transmission lines configured to transmit, to the common electrode, the common voltage generated by the common voltage generating circuit;

a plurality of detectors, which are connected to the plurality of common transmission lines, respectively, and are configured to detect a transmission error of the common voltage in the plurality of common transmission lines, respectively; and a current adjusting unit configured to adjust a current amount of an output current of the common voltage generating circuit based on detection results of the plurality of detectors, wherein the common voltage generating circuit comprises an operational amplifier, the operational amplifier having (i) a first input terminal configured to input a reference voltage, (ii) a second input terminal configured to input a feedback voltage from the common electrode and (iii) an output terminal connected to an input terminal of the current adjusting unit, wherein the current adjusting unit has an output terminal connected to the plurality of common transmission lines, and comprises:

a push-pull circuit comprising two transistors; and a switch configured to short-circuit an input terminal and an output terminal of the push-pull circuit, wherein, when the transmission error has occurred in any one of the plurality of common transmission lines, the current adjusting unit short-circuits the input terminal and the output terminal of the push-pull circuit so that the output current of the operational amplifier is output to, among the plurality of common transmission lines, the common transmission line without the transmission error, and wherein, when no transmission error occurs in the plurality of common transmission lines, the current adjusting unit outputs the output current of the operational amplifier to the plurality of common transmission lines while amplifying the output current by the push-pull circuit.

5. The display device according to claim 4, wherein, when the transmission error has occurred in any one of the plurality of common transmission lines, the current adjusting unit adjusts the output current of the common voltage generating circuit so that a current amount of the output current is reduced.

6. A display device, comprising:

a display panel comprising a pixel electrode and a common electrode;

a common voltage generating circuit configured to generate a common voltage to be supplied to the common electrode;

a plurality of common transmission lines configured to transmit, to the common electrode, the common voltage generated by the common voltage generating circuit;

a plurality of detectors, which are connected to the plurality of common transmission lines, respectively, and are configured to detect a transmission error of the common voltage in the plurality of common transmission lines, respectively; and a current adjusting unit configured to adjust a current amount of an output current of the common voltage generating circuit based on detection results of the plurality of detectors, wherein the common voltage generating circuit comprises an operational amplifier, the operational amplifier having (i) a first input terminal configured to input a reference voltage, (ii) a second input terminal configured to input a feedback voltage from the common electrode and (iii) an output terminal connected to an input terminal of the current adjusting unit, wherein the current adjusting unit has an output terminal connected to the plurality of common transmission lines, and comprises a plurality of resistors having different resistance values from each other, wherein the current adjusting unit is configured to select one of the plurality of resistors based on a number of the common transmission lines in which the transmission error has occurred among the plurality of common transmission lines, and wherein the output terminal of the operational amplifier and the one of the plurality of resistors selected by the current adjusting unit are electrically connected to each other.

7. The display device according to claim 6, wherein, when the transmission error has occurred in any one of the plurality of common transmission lines, the current adjusting unit adjusts the output current of the common voltage generating circuit so that a current amount of the output current is reduced.

8. A display device, comprising:

a display panel comprising a pixel electrode and a common electrode;

a common voltage generating circuit configured to generate a common voltage to be supplied to the common electrode;

a plurality of common transmission lines configured to transmit, to the common electrode, the common voltage generated by the common voltage generating circuit;

a plurality of detectors, which are connected to the plurality of common transmission lines, respectively, and are configured to detect a transmission error of the common voltage in the plurality of common transmission lines, respectively; and a current adjusting unit configured to adjust a current amount of an output current of the common voltage generating circuit based on detection results of the plurality of detectors, wherein the common voltage generating circuit comprises an operational amplifier, the operational amplifier having (i) a first input terminal configured to input a reference voltage and (ii) a second input terminal connected to an output terminal of the current adjusting unit, wherein the current adjusting unit has an input terminal configured to input a feedback voltage from the common electrode, and comprises a plurality of resistors having different resistance values from each other, wherein the current adjusting unit is configured to select one of the plurality of resistors based on a number of the common transmission lines in which the transmission error has occurred among the plurality of common transmission lines, and wherein the second input terminal of the operational amplifier and the one of the plurality of resistors selected by the current adjusting unit are electrically connected to each other.

9. The display device according to claim 8, wherein, when the transmission error has occurred in any one of the plurality of common transmission lines, the current adjusting unit adjusts the output current of the common voltage generating circuit so that a current amount of the output current is reduced.

* * * * *